United States Patent [19]

Carlson

[11] 3,955,509

[45] May 11, 1976

[54] FUEL-AIR MUNITION AND DEVICE

[75] Inventor: Gary A. Carlson, Albuquerque, N. Mex.

[73] Assignee: The United States of America as represented by the United States Energy Research and Development Administration, Washington, D.C.

[22] Filed: Mar. 21, 1969

[21] Appl. No.: 809,440

[52] U.S. Cl. ..... 102/90; 149/1; 149/74; 149/109.4

[51] Int. Cl.[2] ..... F42B 11/24

[58] Field of Search ..... 102/6, 90, 66; 149/74, 149/1, 109.4, 109

[56] References Cited

UNITED STATES PATENTS

| | | | |
|---|---|---|---|
| 2,372,264 | 3/1945 | Firth | 102/6 |
| 3,505,957 | 4/1970 | Tichauer et al. | 102/6 |

*Primary Examiner*—Stephen J. Lechert, Jr.
*Attorney, Agent, or Firm*—Dean E. Carlson; Dudley W. King

[57] ABSTRACT

An aerially delivered fuel-air munition consisting of an impermeable tank filled with a pressurized liquid fuel and joined at its two opposite ends with a nose section and a tail assembly respectively to complete an aerodynamic shape. On impact the tank is explosively ruptured to permit dispersal of the fuel in the form of a fuel-air cloud which is detonated after a preselected time delay by means of high explosive initiators ejected from the tail assembly. The primary component in the fuel is methylacetylene, propadiene, or mixtures thereof to which is added a small mole fraction of a relatively high vapor pressure liquid diluent or a dissolved gas diluent having a low solubility in the primary component.

8 Claims, 4 Drawing Figures

INVENTOR.
Gary A. Carlson
BY
Attorney

FUEL-AIR MUNITION AND DEVICE

BACKGROUND OF THE INVENTION

This invention relates generally to the field of chemical munitions and more particularly to devices of this character wherein a container of pressurized liquid fuel is ruptured on impact. The liquid fuel thereupon vaporizes, disperses, and mixes with air in the form of a cloud which is then detonated by small high explosive charges. "Detonation" is defined herein as an exothermic reaction which propagates at supersonic velocity. "Explosion" is defined as a rapid exothermic reaction at subsonic velocities. In the discussion that follows it will be understood that "detonation" of a fuel-air cloud is always the desired goal, rather than "explosion" of such cloud which would be accompanied by overpressures of lesser magnitude. Detonation occurs only over an area in which the volume percent of fuel in air in the cloud is within certain fairly well defined upper and lower limits generally referred to as the "detonability limits." Ordinarily a time delay of a few seconds is introduced between impact of the device and detonation of the cloud to allow for fuel dispersal time and for the cloud to grow in size over some desired area. Any factor which affects fuel dispersal or cloud growth may inhibit the development of the desired fuel-air ratio over this area. In confined spaces, for example, such as densely forested areas wherein cloud growth is impeded, a relatively fuel-rich mixture may still persist at the time established for cloud detonation. If the volume percent of fuel in such a cloud exceeds the upper detonability limit of the fuel, then no detonation will occur and the device is not completely successful even though the possibility of burning or explosion may still exist.

This illustrates a disadvantage of a prior art device of the character described herein which has employed propane as the detonable fuel. The success of such a device is found to be limited in part because the detonability limits of propane-air mixtures are between 3 and 8% by volume. A fuel-rich cloud might easily exhibit a fuel volume percent substantially greater than 8%. Obviously, therefore, it would be an advantage to substitute for propane a fuel with a higher upper detonability limit.

Unfortunately, fuels which possess a high upper detonability limit tend to be thermodynamically unstable and their equilibrium vapor phases will usually be flammable even in the absence of air at room temperature (approximately 27° C.) and above. In filling the tank of devices of the character to be described, fuel is normally introduced in sufficient quantity and at a pressure such that its liquid phase occupies the substantial proportion, say, at least 90% of the available space in the tank, and the vapor phase in equilibrium occupies the remainder. It is important that this vapor phase shall be nonflammable at temperatures normally to be encountered in handling and storage.

This problem requires the addition of diluents to the primary fuel composition in order to render the vapor phase nonflammable. The function of a diluent is to act as an energy sink in the event of decomposition of the primary fuel composition. If present in sufficient quantities in the vapor phase the diluent will render the fuel nonflammable over a desired range of temperatures and pressures. For example, one such fuel considered for use in a device as described herein is an intermixture of hydrocarbons consisting of methylacetylene, propadiene, or mixtures thereof (hereinafter designated, in any proportions, as $C_3H_4$) together with a substantial quantity (up to about 38%) of a mixture of other hydrocarbons, primarily propylene and propane. This fuel has a higher fuel-rich (upper) detonability limit than propane due primarily, it is felt, to the presence of the unsaturated hydrocarbon $C_3H_4$. Although the vapor phase of $C_3H_4$ is known to be flammable at room temperature and above, with the presence of sufficient quantities of propane or propylene such vapor phase can be rendered nonflammable at such temperature.

The presence of a propane or propylene diluent in such large quantities has the important drawback, however, that it substantially reduces the upper detonability limit otherwise obtainable with $C_3H_4$ fuel-air mixtures alone. Thus if a fuel composition can be devised employing $C_3H_4$ as the primary constituent in the liquid phase while substantially decreasing the mole percent of diluent required in the liquid phase to stabilize the gas phase, a significant improvement can be expected in the upper detonability limits of the fuel-air mixtures obtainable.

In devices of this type the energy required for initiating a detonation of the fuel-air cloud is also a matter of concern. It is obviously advantageous to keep such energy to a reasonably low level. Further improvement in the device to be described can be achieved with a reduction of the present energy requirements for initiating a detonation of fuel-air clouds resulting from liquid propane fuel or $C_3H_4$ plus substantial quantities of propane or propylene diluents. It is recognized that if the liquid fuel can be altered to consist of $C_3H_4$ in a more pure form, the energy requirement for initiating fuel-air cloud detonation can be substantially lowered.

SUMMARY OF INVENTION

An object of the invention is thus to provide a fuel-air munition capable of dispersing a fuel-air cloud detonable over a wide range of fuel-air mixtures.

A further object of the invention is to provide a fuel-air munition wherein the energy required to initiate a detonation of the fuel-air cloud is minimized.

Another object of this invention is to provide a fuel-air munition wherein the detonability limits of the fuel-air cloud are substantially expanded while retaining the nonflammable characteristics of the fuel vapor phase over a desired temperature range.

In the present invention these and other objects are fulfilled in a device of the character to be described including means for delivering a pressurized liquid fuel to a desired location and there dispersing it to form a detonable fuel-air cloud and means for thereafter initiating a detonation of said cloud at a predetermined time, said fuel comprising a primary component consisting of $C_3H_4$ and a secondary component consisting of a small mole percent of a liquid diluent of relatively high vapor pressure or a dissolved gas diluent selected from a group of gases above their critical temperatures having low solubility in the primary component.

DESCRIPTION OF DRAWINGS

The present invention is described in the accompanying drawings wherein.

DETAILED DESCRIPTION

Figure 1:
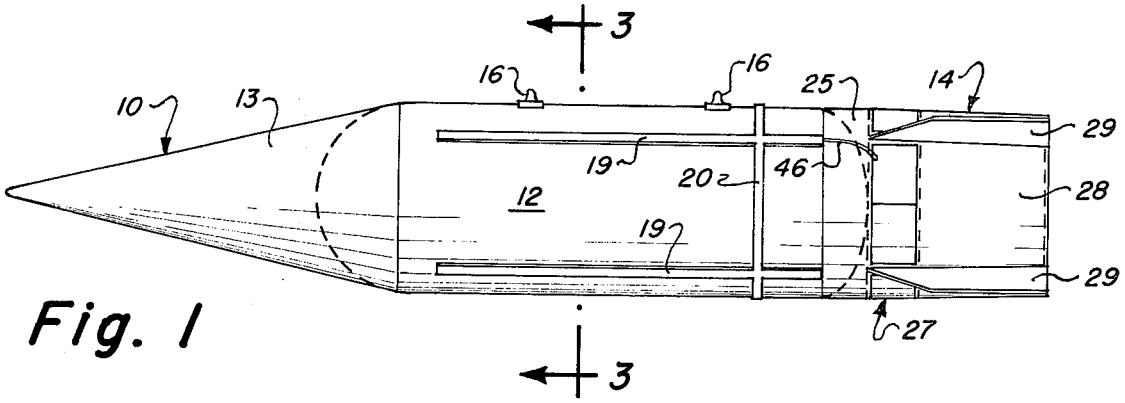
FIG. 1 is a side elevational view of a fuel-air munition in accordance with this invention.

Referring more particularly to FIG. 1 of the drawings, a body 10 is shown comprising a generally cylindrical impermeable tank 12, a nose section 13, and a tail assembly 14 joined together to form a suitable aerodynamic shape. Body 10 is illustrated in the orientation in which it is normally supported by a carrying aircraft through a plurality of suspension lugs 16 and as positioned during a filling operation and for storage. Tank 12, preferably constructed of mild steel, is designed to hold, under pressure, a liquid fuel composition of predetermined characteristics. A plurality of explosive strips 19 are disposed in an axial direction along the outer surface of tank 12, and a similar explosive strip 20, also affixed to the outer surface of tank 12, intersects explosive strips 19 and encircles tank 12 in a lateral direction. Explosive strips 19 and 20 may conveniently be formed of an outer metallic portion and an inner core of explosive imbedded in a matrix of plasticized rubber.

Nose section 13 may be constructed of mild steel or other suitable material and welded to tank 12 as shown. The internal spaces of nose section 13 may be substantially filled with any of several foam materials for shock mitigation. Opposite nose section 13 tail assembly 14 may also be welded to tank 12 through an intermediate skirt 25 to provide necessary streamlining. As shown in FIG. 1, tail assembly 14, which is preferably constructed of aluminum, consists generally of an initiator case section 27, a parachute container 28, and external guide fins 29. A device constructed in accordance with this invention may be either parachute retarded or subjected to free fall. In the latter event, obvious modifications of tail assembly 14 would be made.

Figure 2:
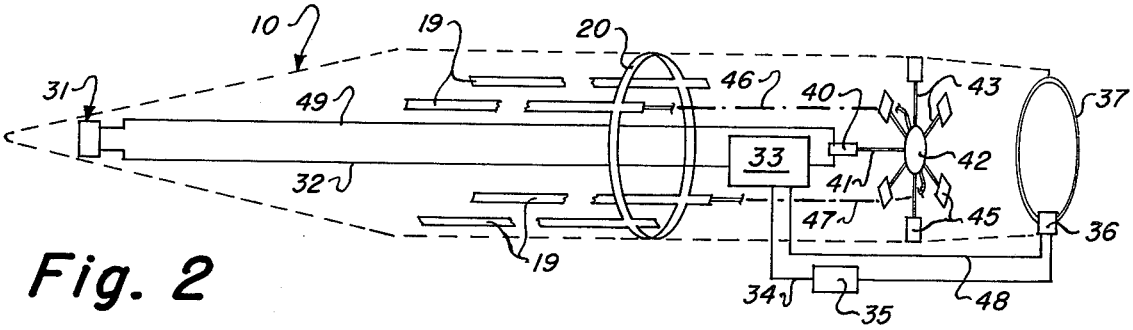
FIG. 2 is a skeleton view of the fuel-air munition illustrating significant electrical circuitry and explosive systems.

The internal details of the device of this invention may be understood better with reference to FIG. 2. Housed within nose section 13 there is a crush switch assembly 31 which may consist of a plurality of individual switches, each of which is adapted to effect an electrical contact closure under specific impact forces. Electrical lead 32 connects crush switch assembly 31 to thermal battery 33 housed in initiator case section 27. Thermal battery 33 is connected through a delay line 35 by lead 34 to a parachute detonator 36 located at the back end of parachute container 28 and positioned in explosive contact with explosive charge 37.

Thermal battery 33 is also connected to fusing detonator 40 which is in turn connected by an explosive lead 41 to explosive distributor 42. A plurality of similar explosive leads 43 are connected between distributor 42 and each of a plurality of high explosive initiators 45 disposed radially outward from distributor 42 around the periphery of initiator case section 27. Explosive leads 46 and 47 are illustrative of suitable connections which may be made between distributor 42 and explosive strips 19 and 20.

To complete the internal electrical circuitry, lead 48 connects thermal battery 33 and chute detonator 36. Also lead 49 connects crush switch assembly 31 and fusing detonator 40.

Figure 3:
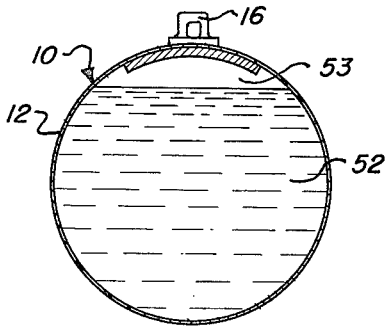
FIG. 3 is a sectional view of the fuel-air munition taken on line 3—3 in FIG. 1.

With reference to FIG. 3, tank 12 is filled under predetermined pressure with a desired fuel composition so that an equilibrium condition exists between its liquid phase 52 and vapor phase 53. The filling operation may be accomplished in various ways, the details of which are well understood in the art and thus are not deemed necessary to describe in this application. It will be understood, however, that a filling operation is conducted such that little or no air remains in tank 12 after the fill is complete. Suitable valving means, of course, are required for this operation and for bleeding off air to the outside of tank 12. The liquid phase 52 must be monitored to insure that it does not fill the entire available space within tank 12 and normally liquid level gauge means of some standard construction are provided to monitor this operation.

In operation, on the release of body 10 at a desired time, thermal battery 33 is activated by, for example, a pull-out lanyard. After traversing delay 35, which may typically be set at one second, a signal from thermal battery 33 activates chute detonator 36 which in turn sets off explosive charge 37 effecting deployment of suitable parachute means from container 28 (not shown) to retard the fall of body 10. As noted above, for free fall weapons this portion of the device becomes unnecessary.

Normally crush switch assembly 31 is provided with individual crush switches which are selectively responsive to varying impact forces. For example, one switch may sense a soft impact on water and provide switch closure at that time. Others may activate only upon contact with a so-called "hard target." It is advantageous to construct the individual switches such that intermediate impacts, as, for example, with branches of trees, do not provide a switch closure. The details of these various switches and their capabilities are not critical to the understanding of the present invention.

When electrical contact is made within crush switch assembly 31, power flows from thermal battery 33 to fusing detonator 40. With normally millisecond delay, explosive lead 41 burns to distributor 42 from which an explosive impulse is transmitted through explosive leads 43 to each of initiators 45. Through separate means (not shown) initiators 45 are ejected radially outward from initiator case section 27 with sufficient force to propel them some predetermined distance from the body 10.

At the same time that distributor 42 provides its signal to initiators 45, explosive leads 46 and 47 burn rapidly to set off the explosives in strips 19 and 20 which are adapted to cut and rupture the wall of tank 12. The liquid phase 52 of the fuel within tank 12 instantly begins to vaporize due to the sudden drop in pressure and through its internal cavitation action is self-dispersed into the surrounding atmosphere where it forms a fuel-air cloud. When this cloud reaches a desired size, which may typically take from 4 to 5 seconds, initiators 45, each having a time delay feature, explode to detonate the fuel-air cloud.

In accordance with this invention a fuel composition is provided to be used in the device as described, the primary component of which is $C_3H_4$ and the secondary component is a diluent consisting of (1) a liquid of relatively high vapor pressure or (2) a dissolved gas above its critical temperature having a low solubility in $C_3H_4$. This composition relies in part on the fact that if a stabilizing diluent in the liquid phase of the composition has a substantially higher vapor pressure than that of the primary component, its mole fraction in the vapor phase will be much higher than its mole fraction in the liquid phase. Such a diluent can therefore be present in the vapor phase in sufficient quantities to render it nonflammable at or above room temperature while diluting the primary component very little. Since the constituents of the liquid phase in the device of the character described determine essentially the content of the fuel dispersed on impact, such a choice of diluent insures that a high proportion of $C_3H_4$ will appear in the resulting fuel-air cloud. In this manner the detonability limits of such cloud may be substantially increased and also the energy required to initiate cloud detonation is decreased.

One diluent which possesses the above characteristics is ethane $C_2H_6$. A comparison of the significant characteristics of ethane with those of propane and propylene may be best understood by reference to the following tables:

TABLE I

Diluent-Methylacetylene Relationships for Nonflammable Vapor Mixtures at 21° C. in a 12" Diameter Reactor

| Diluent | Diluent Limit Percent(Vapor phase) at 100 psig,120°C. | Diluent Vapor Pressure(psia) at 21° C. | Mole Percent Liquid Diluent | Total Pressure |
|---|---|---|---|---|
| $C_2H_6$ ethane | 31 | 568 | 5.2 | 93.5 |
| $C_3H_6$ propylene | 22 | 152 | 11.2 | 77.5 |
| $C_3H_8$ propane | 18 | 124 | 10.7 | 73.5 |

Table II

Diluent-Equimolar $C_3H_4$ Relationships for Nonflammable Vapor Mixtures at 21° C. in a 12" Diameter Reactor

| Diluent | Diluent Limit Percent(Vapor phase) at 100 psig,120°C. | Diluent Vapor Pressure(psia) at 21° C. | Mole Percent Liquid Diluent | Total Pressure |
|---|---|---|---|---|
| $C_2H_6$ ethane | 37 | 568 | 8.45 | 130 |
| $C_3H_6$ propylene | 27 | 152 | 18.0 | 101 |
| $C_3H_8$ propane | 22 | 124 | 17.0 | 96 |

Note first that the vapor pressure of ethane at 21° C., 568 psia, is over eight times that of methylacetylene, which is 68 psia. This may be contrasted with the much lower vapor pressures of propylene and propane, namely, 152 psia and 124 psia respectively. Observe with reference to Table I that the mole percentage of ethane required in the liquid phase to render the vapor phase nonflammable at 21° C. is less than half the percentage required of either propane or propylene. Note also that there is a substantial difference in the mole fraction of ethane in the liquid and vapor phases.

Table II illustrates similar results for mixtures of equimolar $C_3H_4$ (equal parts of methylacetylene and propadiene) with the same three diluents. Note once again that the mole percent of ethane in the liquid phase required for rendering the vapor phase nonflammable is less than half of that required for propane and propylene and that again there is a substantial difference in the mole fraction of ethane in the liquid and vapor phases.

Comparative calculations on which the data in Tables I and II are based are made for a 12 inch diameter vessel. Experiment indicates that the mole percentage of diluent required to render the vapor phase of a fuel of the type described nonflammable tends to level off at such a vessel size. It is reasonable to expect therefore that these calculations will be valid for larger volumes such as might be involved in tank 12 of the present device.

Other compositions which may be employed as the liquid diluent in place of ethane, all of which exhibit correspondingly high vapor pressures, are the following:

chlorotrifluoromethane ($CF_3Cl$) (460 psig)
1,1 difluoroethylene ($C_2H_2F_2$) (518 psig)
trifluoromethane ($CF_3H$) (635 psig)
hexafluoroethane ($C_2F_6$) (445 psig)
methyl fluoride ($CH_3F$) (560 psig)
nitrous oxide ($N_2O$) (745 psig)
sulfur hexafluoride ($SF_6$) (310 psig)
vinyl fluoride ($C_2H_3F$) (355 psig)

Preferred concentrations in the total fuel composition should range from about 70 to 95 mole percent of methylacetylene, propadiene, and mixtures thereof and from about 5 to 30 mole percent of a liquid diluent selected from the above recited group of high vapor pressure compositions.

As a possible substitute for the above discussed liquid diluents for use in the fuel composition of this invention, one may employ one of a group of diluent gases which are above their critical temperature at 27° C. The important characteristics which these gases must have in common is a low solubility in $C_3H_4$ and the ability to act as a heat sink in the vapor phase. Gases which have the necessary properties include:

methane ($CH_4$)
ethylene ($C_2H_4$)
tetrafluoromethane ($CF_4$)
carbon dioxide ($CO_2$)
carbon monoxide (CO)
hydrogen ($H_2$)
nitric oxide (NO)
nitrogen ($N_2$)

Preferred concentrations in the total fuel composition employing a diluent gas as described above range from about 90 to 99 mole percent of methylacetylene, propadiene, and mixtures thereof and from about 1 to 10 mole percent of a dissolved gas diluent selected from the above listed compositions.

Figure 4:
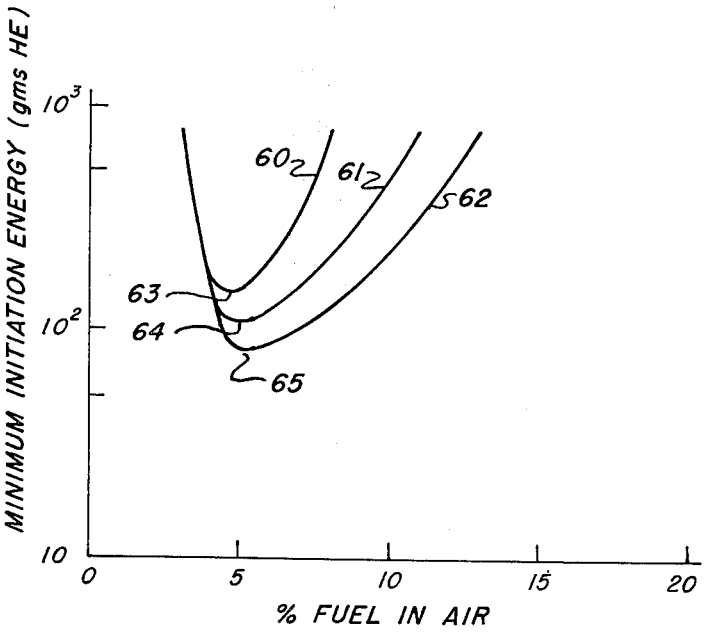
FIG. 4 is a graph showing comparative detonability characteristics of various fuel-air mixtures.

The significance of the results obtainable in a device of the character described employing a fuel composition as detailed herein can be appreciated generally by reference to FIG. 4, which is intended to compare in a general way the detonation energy requirements for the prior art fuel compositions discussed above and those of this invention. Curve 60 corresponds to propane which, as noted previously, has a very low upper detonability limit. Experiment shows that this upper limit may be extended by the introduction of $C_3H_4$ in a fuel composition even with substantial mole percentages (up to 38%) of propane and propylene diluents (curve 61). As the mole percentage of diluents is decreased in accordance with the present invention, the upper detonability limit, based on the foregoing data, should be still further extended (curve 62). It may be noted that the upper detonability limit of acetylene, a highly unsaturated fuel similar to $C_3H_4$, has been measured to be 100% in shock tube tests. Points 63, 64, and 65 denote the minimum energy required to initiate detonation in a stoichiometric fuel-air mixture for each of the three compositions shown. The expected downward progression of this energy level from propane to the fuel of this invention further enhances the latter's versatility.

In summary, it should be stated that a device of the character described employing a fuel composition as set forth herein may be expected to perform more reliably because of the extension of the upper detonability limits of the fuel-air cloud produced and also because of the lower energy requirements for detonation of the cloud, while assuring nonflammability of the fuel in normal conditions of storage and handling.

Fuel compositions of the type described will also have utility in other areas in addition to the context of the present invention, for example, in the welding art and other fields in which high temperature gas flames may be required.

It will be understood that various changes in the details, compositions, and arrangement of parts which have been herein described and illustrated in order to explain the nature of the invention may be made by those skilled in the art within the principle and scope of the invention as expressed in the appended claims.

What is claimed is:

1. A device comprising a liquid fuel, means for delivering said liquid fuel under pressure to a desired location, means for there dispersing said liquid to form a detonable fuel-air cloud and means for thereafter initiating the detonation of said cloud at a predetermined time, said liquid fuel comprising essentially from about 70 to 95 mole percent of a primary component selected from the group consisting of methylacetylene, propadiene, and mixtures thereof and from about 30 to 5 mole percent of a secondary component selected from the group consisting of ethane, chlorotrifluoromethane, 1,1 difluoroethylene, trifluoromethane, hexafluoroethane, methyl fluoride, nitrous oxide, sulfur hexafluoride, and vinyl fluoride.

2. A device comprising a liquid fuel, means for delivering said liquid fuel under pressure to a desired location, means for there dispersing said liquid fuel to form a detonable fuel-air cloud and means for thereafter initiating the detonation of said cloud at a predetermined time, said fuel comprising essentially from about 90 to 99 mole percent of a primary component selected from the group consisting of methylacetylene, propadiene, and mixtures thereof and from about 10 to 1 mole percent of a secondary component selected from the group consisting of methane, ethylene, tetrafluoromethane, carbon dioxide, carbon monoxide, hydrogen, nitric oxide and nitrogen.

3. A device comprising a liquid fuel, means for delivering said liquid fuel under pressure to a desired location, means for there dispersing said liquid fuel to form a detonable fuel-air cloud and means for thereafter initiating the detonation of said cloud at a predetermined time, the fuel comprising essentially about 95 mole percent of methylacetylene and about 5 mole percent ethane.

4. A device comprising a liquid fuel, means for delivering said liquid fuel under pressure to a desired location, means for there dispersing said liquid fuel to form a detonable fuel-air cloud and means for thereafter initiating the detonation of said cloud at a predetermined time, said fuel comprising essentially about 92 mole percent of equal parts of methylacetylene and propadiene and about 8 mole percent of ethane.

5. The fuel comprising essentially from about 70 to 95 mole percent of a primary component selected from the group consisting of methylacetylene, propadiene, and mixtures thereof and from about 5 to 30 mole percent of a secondary component selected from the group consisting of ethane, chlorotrifluoromethane, 1,1 difluoroethylene, trifluoromethane, hexafluoroethane, methyl fluoride, nitrous oxide, sulfur hexafluoride, and vinyl fluoride.

6. The fuel comprising essentially from about 90 to 99 mole percent of a primary component selected from the group consisting of methylacetylene, propadiene, and mixtures thereof and from about 1 to 10 mole percent of a secondary component selected from the group consisting of methane, ethylene, tetrafluoromethane, carbon dioxide, carbon monoxide, hydrogen, nitric oxide, and nitrogen.

7. The fuel comprising essentially about 95 mole percent of methylacetylene and about 5 mole percent ethane.

8. The fuel comprising essentially about 92 mole percent of equal parts of methylacetylene and propadiene and about 8 mole percent of ethane.

* * * * *